US008290384B2

(12) United States Patent
Hyakutake et al.

(10) Patent No.: US 8,290,384 B2
(45) Date of Patent: Oct. 16, 2012

(54) IMAGE FORMING DEVICE

(75) Inventors: Nobuo Hyakutake, Atsugi (JP); Taku Fukuhara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 239 days.

(21) Appl. No.: 12/783,882

(22) Filed: May 20, 2010

(65) Prior Publication Data

US 2011/0076041 A1 Mar. 31, 2011

(30) Foreign Application Priority Data

Sep. 25, 2009 (JP) ..... 2009-219939
Feb. 4, 2010 (JP) ..... 2010-023440

(51) Int. Cl.
*G03G 15/16* (2006.01)

(52) U.S. Cl. ..... 399/66; 399/101; 399/298; 399/302

(58) Field of Classification Search ..... 399/66, 399/101, 298, 302
See application file for complete search history.

(56) References Cited

U.S. PATENT DOCUMENTS 5,740,508 A * 4/1998 Matsuura et al. ..... 399/308
7,593,665 B2 * 9/2009 Hamada et al. ..... 399/101
7,693,441 B2 * 4/2010 Nishikawa ..... 399/71
7,869,751 B2 * 1/2011 Adachi et al. ..... 399/316
7,949,269 B2 * 5/2011 Takeuchi ..... 399/46
2006/0088342 A1 * 4/2006 Hamada et al. ..... 399/296
2007/0172247 A1 * 7/2007 Horiuchi et al. ..... 399/66
2008/0187369 A1 * 8/2008 Nakagawa et al. ..... 399/310
2008/0310896 A1 * 12/2008 Shono et al. ..... 399/350
2009/0175640 A1 * 7/2009 Nishiwaki et al. ..... 399/50

FOREIGN PATENT DOCUMENTS

JP A-10-73999 3/1998
JP A-2001-337546 12/2001
JP A-2002-91127 3/2002

* cited by examiner

*Primary Examiner* — David Gray
*Assistant Examiner* — Francis Gray
(74) *Attorney, Agent, or Firm* — Oliff & Berridge, PLC

(57) ABSTRACT

An image forming device includes: image forming sections that form toner images with charged toners of respective colors on respective surfaces of image retainers; a transfer accepting body to whose surface the toner images are transferred electrostatically; transfer members that transfer the toner images to the transfer accepting body; a first charge applying section that switches, according to an instruction, between a first mode of applying the charge to all the transfer members and a second mode of applying the charge to apart of the transfer members; and a second charge applying section that applies, when the charge is applied in the second mode, a charge having the same polarity as that of the charged toners, to the transfer accepting body surface, at an applying point upstream from where the toner images are transferred to the transfer accepting body in a moving direction of the transfer accepting body.

15 Claims, 16 Drawing Sheets

IMAGE FORMING DEVICE

CROSS-REFERENCE TO RELATED APPLICATION

This application is based on and claims priority under 35 USC 119 from Japanese Patent Application No. 2010-023440, filed Feb. 4, 2010.

BACKGROUND (i) Technical Field

The present invention relates to an image forming device.

(ii) Related Art

Conventionally, there is known an image forming device that forms a full-color image by causing image forming sections to form toner images by using the respective toners of mutually different colors, sequentially transferring the formed toner images to an intermediate transfer member where the formed toner images are laminated, and then fixing the transferred toner images.

SUMMARY

According to an aspect of the invention, an image forming device includes:

plural image retainers that respectively retain images of respective colors formed on respective surfaces while rotating;

plural image forming sections that respectively form toner images with charged toners of the respective colors on the respective surfaces of the plural image retainers;

a transfer accepting body that circulates on a course passing through the plural image retainers sequentially and has a surface to which the toner images on the respective image retainers are transferred electrostatically;

plural transfer members that respectively face the plural image retainers across the transfer accepting body interposed in between, are given a charge that provides the image retainers with a potential difference having a polarity opposite to a polarity of the charged toners, and transfer the toner images formed on the plural image retainers to the transfer accepting body;

a first charge applying section that applies the charge to at least one of the transfer members and switches, according to an instruction, between a first mode of applying the charge to all the plural transfer members and a second mode of applying the charge to a part of the plural transfer members; and a second charge applying section that applies, when the charge is applied in the second mode, a charge having the same polarity as the polarity of the charged toners, to the surface of the transfer accepting body, at an applying point located upstream from points where the toner images are transferred to the transfer accepting body in a moving direction of the transfer accepting body.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to the drawings.

Figure 1:
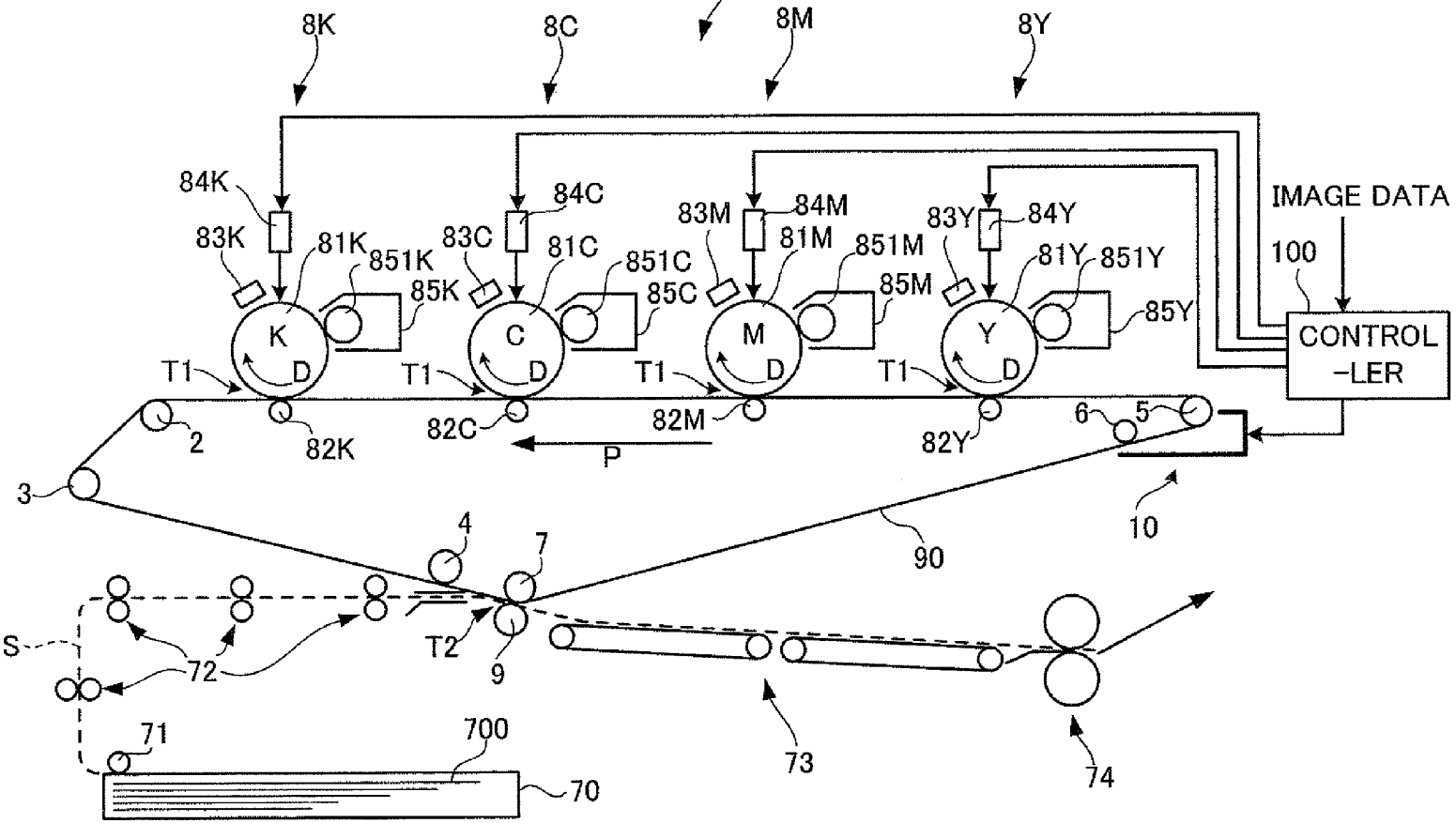
FIG. 1 is a schematic structural diagram of an image forming device.

FIG. 1 is a schematic structural diagram of an image forming device.

This is an image forming device 1 that includes four image forming sections 8Y, 8M, 8C and 8K corresponding to colors of yellow (Y), magenta (M), cyan (C) and black (K), respectively, an intermediate transfer belt 90, a cleaning unit 10 and a controller 100. The image forming device 1 has a full-color mode in which these four image forming sections 8Y, 8M, 8C and 8K are operated to form a full-color image, and a monochrome mode in which only the image forming section 8K of black (K) is operated to form a monochrome image. The switching between these modes is carried out by an operator through a control panel (not illustrated) of the image forming device 1. The image forming device 1 is a first exemplary embodiment of the image forming device according to the present invention. Further, the full-color mode is equivalent to an example of the first mode according to the present invention, and the monochrome mode is equivalent to an example of the second mode according to the present invention.

The intermediate transfer belt 90 is held by a drive roll 5, support rolls 2 and 4, a tension roll 3, a supplementary roll 6 and a back-up roll 7.

The drive roll 5 is rotated to drive the intermediate transfer belt 90 so that the intermediate transfer belt 90 moves in the direction of an arrow P and circulates. The tension roll 3 enables the intermediate transfer belt 90 to maintain a tension of a certain strength or greater. The back-up roll 7 is provided to keep the distance between the toner image transferred on the intermediate transfer belt 90 and a secondary transfer roll 9 constant.

The four image forming sections 8Y, 8M, 8C and 8K are aligned along the intermediate transfer belt 90, downstream from the drive roll 5 and upstream from the support roll 2 on the path of the movement of the intermediate transfer belt 90. The intermediate transfer belt 90 is equivalent to an example of the transfer accepting body according to the present invention.

The image forming sections 8Y, 8M, 8C and 8K have: photoreceptor rolls 81Y, 81M, 81C and 81K each rotating in the direction of an arrow D; charging devices 83Y, 83M, 83C and 83K; exposure devices 84Y, 84M, 84C and 84K; developing devices 85Y, 85M, 85C and 85K; and primary transfer rolls 82Y, 82M, 82C and 82K, respectively. The four image forming sections 8Y, 8M, 8C and 8K are equivalent to examples of the plural image forming sections according to the present invention, the four photoreceptor rolls 81Y, 81M, 81C and 81K are equivalent to examples of the plural image retainers according to the present invention. Further, the four primary transfer rolls 82Y, 82M, 82C and 82K are equivalent to examples of the plural transfer members according to the present invention.

According to an instruction provided by the operator to switch between the above-mentioned modes, the controller 100 controls movements of the four image forming sections 8Y, 8M, 8C and 8K of the image forming device 1.

The image forming device 1 further includes a paper feed cassette 70 in which paper sheets 700 are stored, a pickup roll 71 provided on the paper-drawing-out side of the paper feed cassette 70, transport rolls 72, the secondary transfer roll 9, a transportation belt 73 and a fixing device 74.

Next, an operation of forming a full-color image in the image forming device 1 and the function of each section will be described.

When the full-color mode is selected by the operator, in the image forming device 1, at first, the image forming section 8Y for yellow begins formation of a toner image, and the charging device 83Y applies a charge to the surface of the photoreceptor roll 81Y rotating in the direction of the arrow D. Subsequently, the surface of the photoreceptor roll 81Y is irradiated with exposure light corresponding to a yellow image by the exposure device 84Y and thereby an electrostatic latent image is formed. The electrostatic latent image is developed with a yellow toner by the developing device 85Y, and thereby a yellow toner image is formed on the surface of the photoreceptor roll 81Y. The yellow toner image is transferred to the surface of the circulating intermediate transfer belt 90 by the primary transfer roll 82Y at a primary transfer position T1.

The timing of image formation is set in the image forming section 8M for magenta so that a magenta toner image formed on the surface of the photoreceptor roll 81M arrives at the primary transfer roll 82M for magenta at the time when the yellow toner image formed on the intermediate transfer belt 90 arrives at the primary transfer roll 82M. The magenta toner image is overlaid on the yellow toner image on the intermediate transfer belt 90 by the primary transfer roll 82M.

Subsequently, cyan and black toner images are formed by the image forming sections 8C and 8K, respectively, based on the timing similar to that described above. The formed cyan and black toner images are transferred by the respective primary transfer rolls 82C and 82K to be sequentially overlaid on the yellow and magenta toner images on the intermediate transfer belt 90. A laminated toner image made up of the toner images of the four colors on the surface of the intermediate transfer belt 90 is transferred to the surface of a paper sheet 700 that arrives at a secondary transfer position T2 after being drawn from the paper feed cassette 70 by the pickup roll 71 and then conveyed along a transportation path S by the transport rolls 72. The paper sheet 700 to which surface the laminated toner image is transferred is sent by the transportation belt 73 to the fixing device 72 where the laminated toner image is heated and pressurized, thereby fixed on the paper sheet 700 serving as a recording sheet.

In the image forming device 1, the surfaces of the respective photoreceptor rolls 81Y, 81M, 81C and 81K are negatively charged by the charging devices 83Y, 83M, 83C and 83K, respectively. A negative-polarity charge is removed from a part of each of the surfaces negatively charged, which part is irradiated with the exposure light by each of the exposure devices 84Y, 84M, 84C and 84K, and thereby the electrostatic latent image is formed.

Meanwhile, each of the developing devices 85Y, 85M, 85C and 85K contains a developer including a toner and a magnetic carrier. The magnetic carrier is composed of charging particles that charge the toner by friction against the toner, while serving as magnetic particles. In these developing devices 85Y, 85M, 85C and 85K, the developer is agitated, which causes the toner and the magnetic carriers to rub against each other. By this friction, the toner is negatively charged while the magnetic carrier is positively charged. For this reason, in the developing devices 85Y, 85M, 85C and 85K, the toner and the magnetic carrier are made to electrically adsorb each other to be blended together.

Further, each of the developing devices 85Y, 85M, 85C and 85K has a developing roll (not illustrated). The developing roll is negatively biased, and includes a columnar magnetic roll and a cylindrical sleeve rotatably covering the circumference of the columnar magnetic roll. The developing roll rotates while holding the developer by adsorbing the magnetic carrier on the surface of the sleeve by using a magnetic force of the magnetic roll, and thereby conveys the developer to a development area formed between the developing roll and corresponding one of the photoreceptor rolls 81Y, 81M, 81C and 81K. The toner in the developer conveyed to the development area is separated from the magnetic carrier by an electric field generated between the electrostatic latent image formed on the surface of the corresponding one of the photoreceptor rolls 81Y, 81M, 81C and 81K and the developing roll, and then adheres to the electrostatic latent image. In this way, the electrostatic latent image formed on the surface of each of the photoreceptor rolls 81Y, 81M, 81C and 81K is developed by the toner.

The toner image of each color, which has the negative polarity and adheres to the electrostatic latent image, is electrostatically attracted to the intermediate transfer belt 90 side by the primary transfer rolls 82Y, 82M, 82C and 82K to which positive-polarity charges are applied. As a result, the toner images are transferred to the surface of the intermediate transfer belt 90.

The toner images on the intermediate transfer belt 90 after being transferred are electrostatically attracted to the recording sheet side by the secondary transfer roll 9 positive-polarity charges are applied. As a result, the toner images on the intermediate transfer belt 90 are transferred to the surface of the recording sheet.

Next, an operation of forming a monochrome image in the image forming device 1 will be described.

Figure 2:
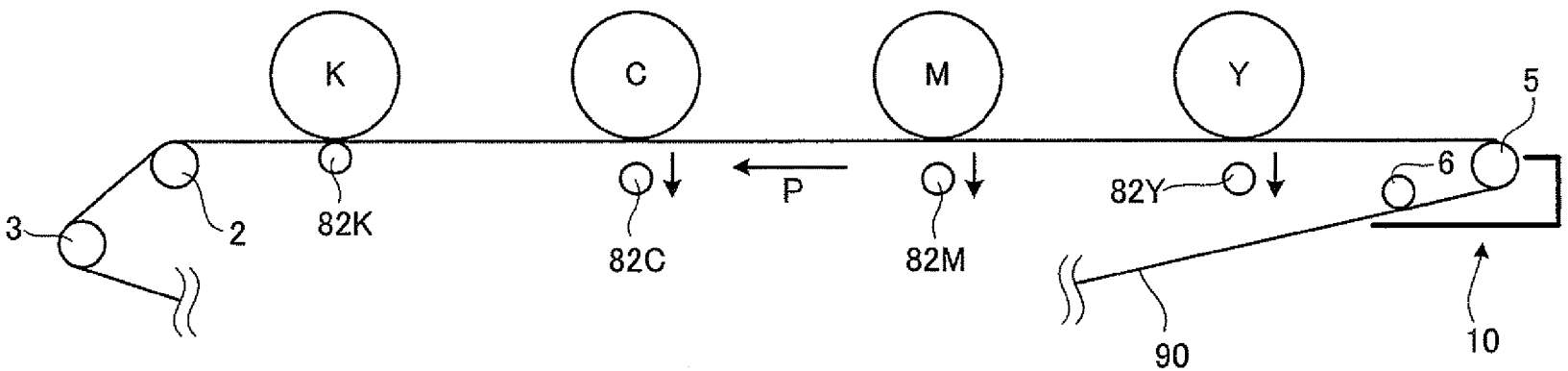
FIG. 2 is a diagram that illustrates a state of the image forming section when the monochrome mode is selected by the operator.

FIG. 2 is a diagram that illustrates a state of the image forming section when the monochrome mode is selected by the operator.

FIG. 2 illustrates the state in which among the primary transfer rolls 82Y, 82M, 82C and 82K of the image forming sections 8Y, 8M, 8C and 8K, the primary transfer rolls 82Y, 82M and 82C of the image forming sections 8Y, 8M and 8C are made to retreat downward.

This is to prevent, in the monochrome mode, the photoreceptor rolls irrelevant to image formation from being uselessly worn out when these irrelevant photoreceptor rolls rotate while strongly contacting the intermediate transfer belt 90 during the transfer of the black toner image formed only by the image forming section 8K for black (K) to the intermediate transfer belt 90.

The black toner image formed only by the image forming section 8K for black (K) is transferred to the surface of the intermediate transfer belt 90 by the primary transfer roll 82K of the image forming section 8K for black (K). The black toner image transferred to the surface of the intermediate transfer belt 90 is secondarily transferred to the surface of a paper sheet and then fixed by heat and pressure. The switching between the above-described movements in accordance with the mode-changing instruction provided by the operator is ordered by the controller 100. This controller 100 is equivalent to an example of the first charge applying section according to the present invention.

Next, features of the intermediate transfer belt 90 of the image forming device 1 according to the present exemplary embodiment will be described.

The intermediate transfer belt 90 is made highly resistant. This is to prevent deletion (white splotches) that occurs, when the toner image transferred to the intermediate transfer belt 90 is transferred to the recording sheet by the secondary transfer section, due to an abnormal discharge among the recording sheet, the toner image and the intermediate transfer belt 90.

Figure 3:
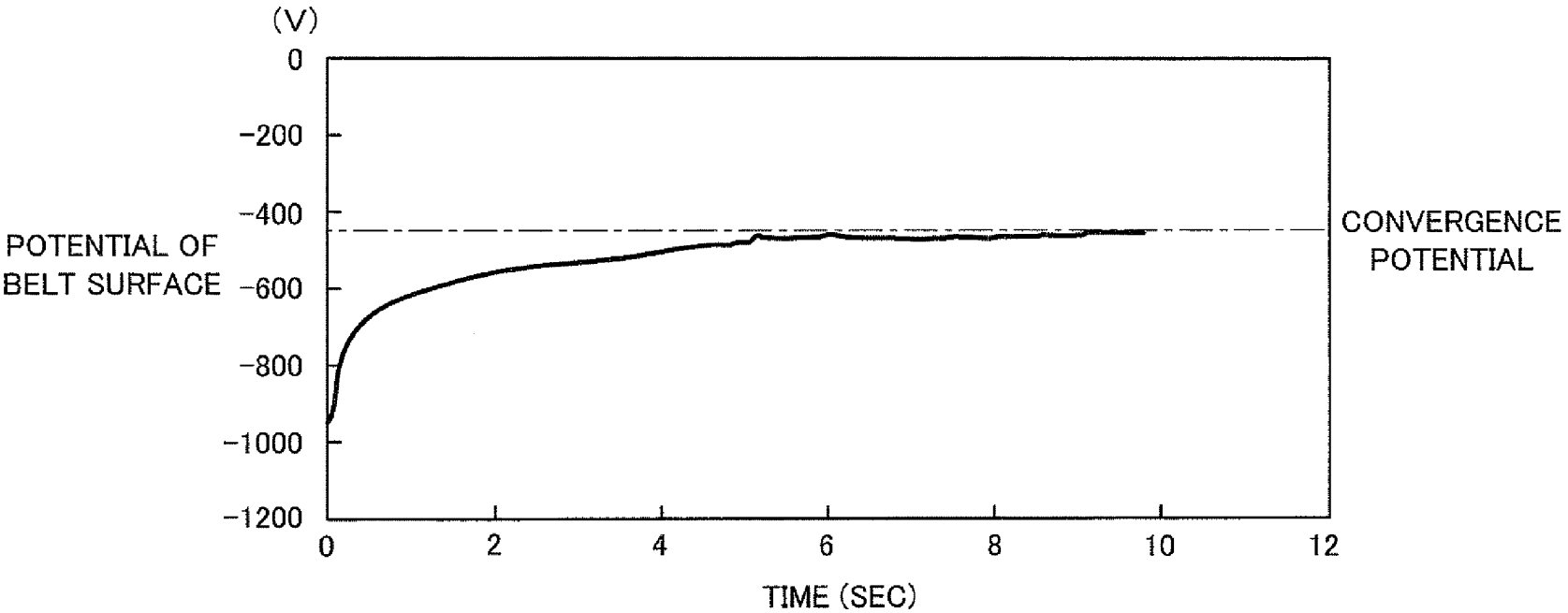
FIG. 3 is a graph that illustrates a decrement curve of a surface potential of the intermediate transfer belt.

FIG. 3 is a graph that illustrates a decrement curve of a surface potential of the intermediate transfer belt.

FIG. 3 illustrates a transition of the surface potential after a potential of −950 V is applied to the surface of the intermediate transfer belt 90 of the image forming device 1 having a volume resistivity of $1\times10^{13}$ Ωcm. Incidentally, conditions for measuring a volume resistance (ρv) are as follows.

Measuring instrument: Ultra high resistance meter/low-current meter R8340A (made by ADVANTEST Corporation)

Probe: UR probe MCP-HTP12 (made by Mitsubishi Chemical Analytech Co., Ltd.)

Applied bias: 500V

Measurement time: 10 seconds

The graph in FIG. 3 illustrates a state in which in the intermediate transfer belt having a high volume resistance, when this intermediate transfer belt is given a negative-polarity charge to some or greater extent, its potential gradually decreases toward the ground side with the passage of time and converges to a certain level of potential on the negative side (hereinafter referred to as "convergence potential"). On the other hand, although illustration is omitted, when a charge on the ground side before the convergence potential is applied, the convergence of potential does not appear and the potential of the applied charge is maintained.

Incidentally, the toner image of each color formed by the negatively charged toner is primarily transferred to the intermediate transfer belt 90 by an electric field produced between each of the primary transfer rolls 82Y, 82M, 82C and 82K to which the positive-polarity voltage is applied and each of the photoreceptor rolls 81Y, 81M, 81C and 81K. The current is controlled to be constant by the primary transfer current. Further, accompanying the occurrence of a separating discharge by this primary transfer current, the surface of the intermediate transfer belt 90 is given a negative potential.

Figure 4:
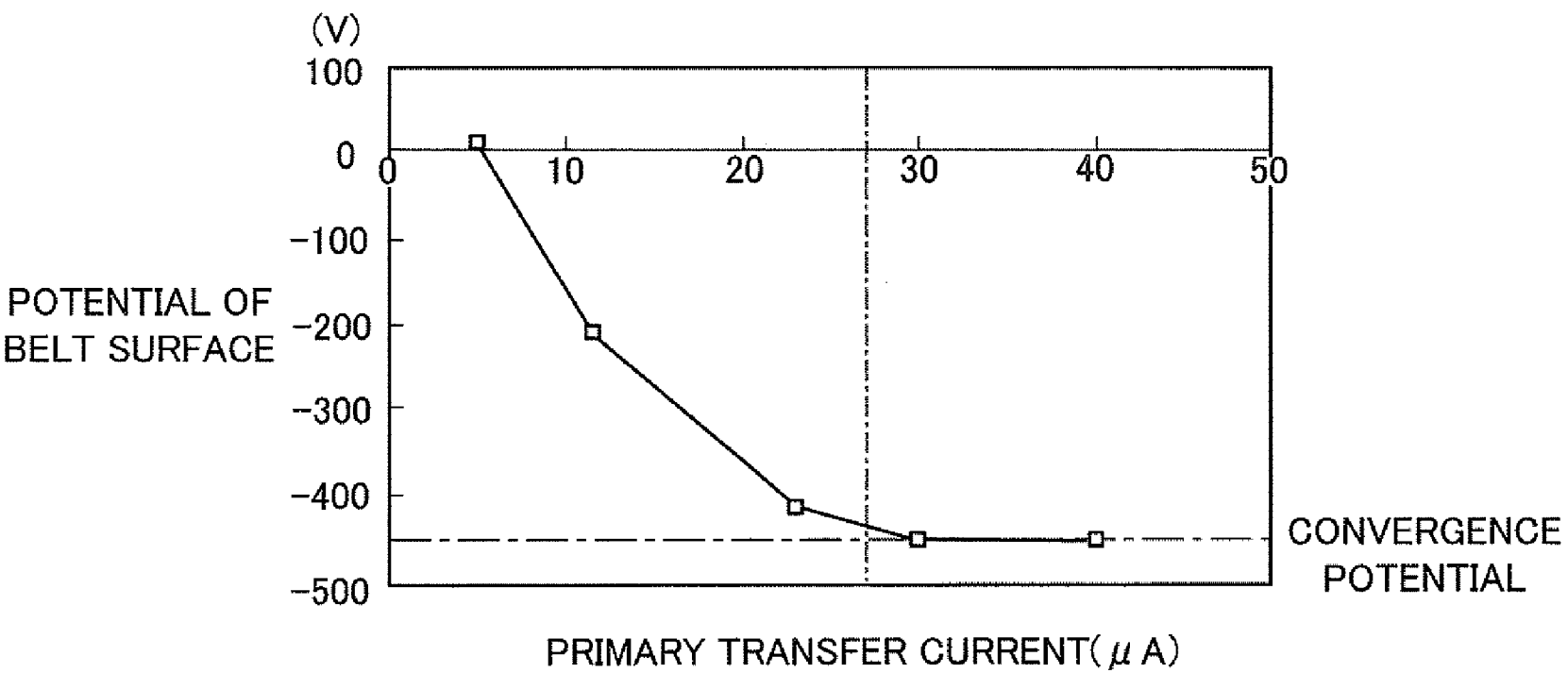
FIG. 4 is a diagram that illustrates a relationship between the primary transfer current and the potential of the surface of the intermediate transfer belt in the full-color mode.

FIG. 4 is a diagram that illustrates a relationship between the primary transfer current and the potential of the surface of the intermediate transfer belt in the full-color mode.

FIG. 4 illustrates a result of causing each of primary transfer rolls of four image forming sections in a general tandem type of image forming device to touch an intermediate transfer belt and causing the intermediate transfer belt to make three rounds in a state in which a secondary transfer roll is given +1,800 V, and then measuring the surface potential, of the intermediate transfer belt at the same position as the support roll 2 of the present exemplary embodiment while uniformly changing the primary transfer current flowing between each of the primary transfer rolls and each of photoreceptors. Here, the measurement is carried out under such conditions that the process speed is 220 mm/sec, the charged width of the primary transfer roll is 320 mm, the resistance value between the secondary transfer roll and the back-up roll 7 is $4\times10^{7}$Ω, the thickness of the intermediate transfer belt is 100 μm, and the volume resistivity is $1\times10^{13}$ Ωcm.

What is read from the graph illustrated in FIG. 4 is that when there is a flow of a current that is smaller than the primary transfer current of 28 μA that actually flows between each of the primary transfer rolls and each of the photoreceptors at the time when a full-color image is formed, the surface potential of the intermediate transfer belt becomes a negative potential closer to the ground side than the convergence potential due to also by the fact that the surface potential is swung toward the positive side by the contact with the secondary transfer roll, and therefore, the surface potential never settles on the convergence potential. On the other hand, it is read from the graph illustrated in FIG. 4 that when there is a flow of a current equal to or larger than the primary transfer current of 28 μA that actually flows between each of the primary transfer rolls and each of the photoreceptors at the time when the full-color image is formed, the surface potential of the intermediate transfer belt becomes a negative potential on the negative side beyond the convergence potential even when the surface potential is swung toward the positive side by the contact with the secondary transfer roll and then, the surface potential settles on the convergence potential.

Figure 5:
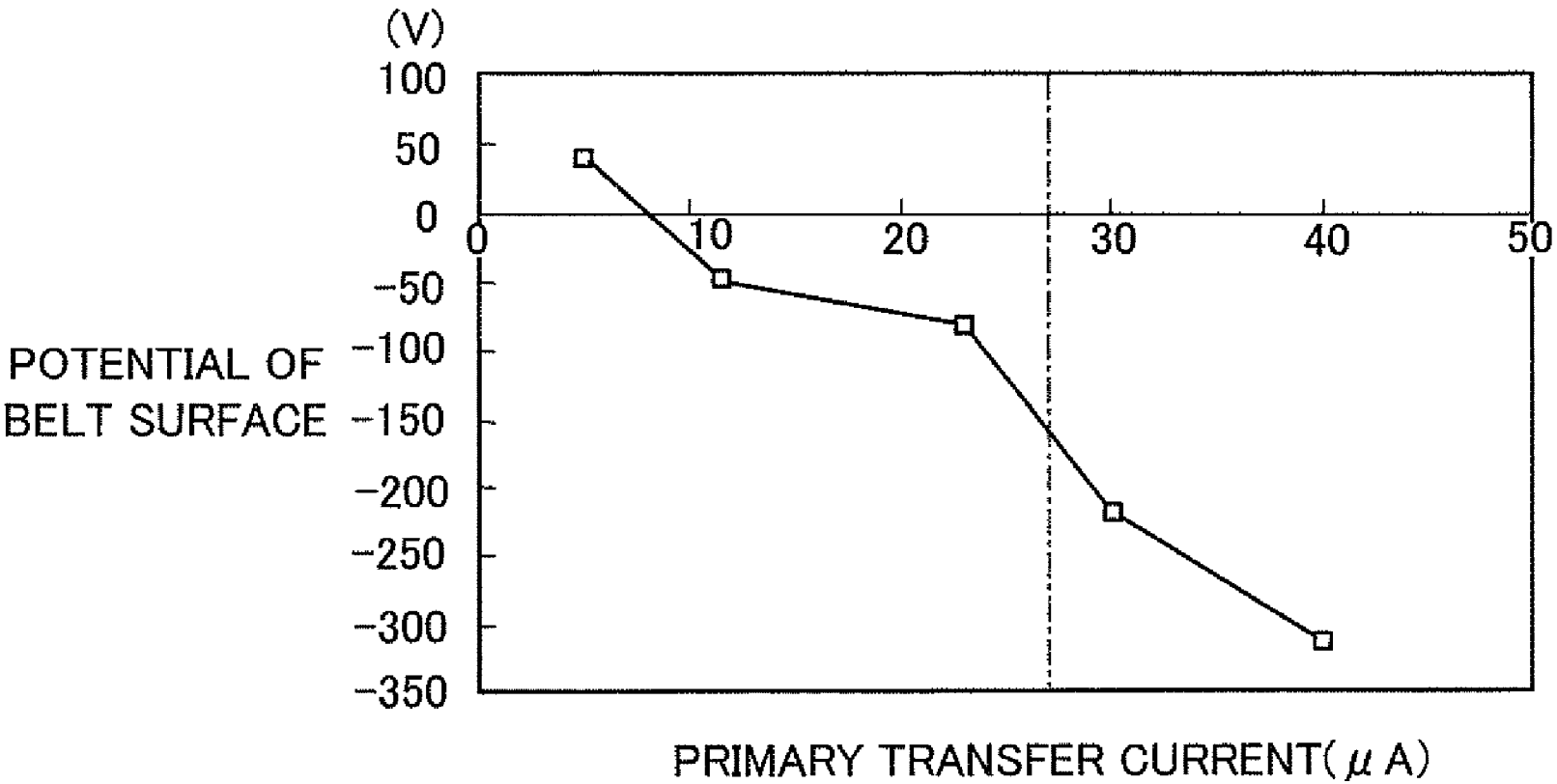
FIG. 5 is a graph that illustrates a relationship between the primary transfer current and the potential of the surface of the intermediate transfer belt in the monochrome mode.

FIG. 5 is a graph that illustrates a relationship between the primary transfer current and the potential of the surface of the intermediate transfer belt in the monochrome mode.

FIG. 5 illustrates, in a general tandem type of image forming device that has a full-color mode of forming a full-color image by operating four image forming sections and a monochrome mode of forming a monochrome image by operating only the image forming section for black (K), and causes only a primary transfer roll for black (K) to touch an intermediate transfer belt in the monochrome mode, after causing the intermediate transfer belt to make three rounds in a state in which a secondary transfer roll is given +1,800 V, and a result of measuring the surface potential of the intermediate transfer belt at the same position as the support roll 2 of the present exemplary embodiment while changing the primary transfer current flowing between the primary transfer roll for black and a photoreceptor for black. Here, the measurement is carried out under such conditions that the process speed is 220 mm/sec, the charged width of the primary transfer roll is 320 mm, the resistance value between the secondary transfer roll and the back-up roll is $4\times10^{7}\Omega$, the thickness of the intermediate transfer belt is 100 μm, and the volume resistivity is $1\times10^{13}$ Ωcm.

What is read from the graph illustrated in FIG. 5 is that the surface potential never reaches a potential on the negative side beyond the convergence potential regardless of the value of the primary transfer current. Thus, in the monochrome mode, since the convergence of the potential does not occur, the given potential is maintained as it is for a long time.

In this way, it is clear that there is a large difference between the full-color mode and the monochrome mode in terms of the potential that is applied to the intermediate transfer belt as the primary transfer takes place.

Incidentally, since the toner of the toner image has a polarity, there is a local difference in the potential applied during the primary transfer between a part corresponding to the background portion of a single picture and a part corresponding to the image portion of the same picture among parts on the intermediate transfer belt. However, in the full-color mode, because of the separating discharge that occurs four times, either part becomes a potential on the negative side beyond the convergence potential. For this reason, either part settles on the convergence potential by the time when the next image formation takes place and thus, there is no potential difference between the parts.

On the other hand, in the monochrome mode, the potential applied in the primary transfer is maintained for a long time as mentioned above and therefore, there is a case in which when the potential locally different between the part corresponding to the image portion and the part corresponding to the background portion is applied, the next primary transfer is performed while the potential difference between these parts is maintained. As a result, the difference in the surface potential between these parts appears in the image, in other words, an image history (a ghost) by the remaining charge is caused. When the surface potential of the intermediate transfer belt before the primary transfer at the time of the occurrence of the ghost is measured, the difference in the surface potential between the part where the image history is formed and the part where the image history is not formed is around 20 V and as a result of analysis, it is found that the reason of the occurrence of the ghost may not be explained by this potential difference. As described above, in the monochrome mode, there is formed an area where the belt is not charged up to the convergence potential in the primary transfer. It is conceivable that after the primary transfer, there is an irregularity of charge along the image dots of the image structure. It is conceivable that this irregularity of charge due to the image structure is not measured as a potential by the surface-potential meter, because this measurement is more macro than the image structure. It is conceivable that because of the occurrence of this irregularity of charge along the image structure, the toner is dispersed at the primary transfer section in the next image formation cycle, which forms the ghost. Further, as a result of specific analysis, it is found, by observation of the intermediate transfer belt after the primary transfer passes, that the toner is dispersed along the image structure in the previous cycle and there is an occurrence of movement. Thus, it is found that, in the monochrome mode, since the transfer is made in the state in which the belt is not charged up to the convergence potential, the irregularity of electric field along the image structure after the primary transfer occurs, which is the cause of the ghost.

In light of the foregoing, the image forming device 1 of the present exemplary embodiment is provided with the cleaning unit 10, which will be described below, to prevent the occurrence of the image history due to the remaining charge of the intermediate transfer belt 90 at the time of the image formation in the monochrome mode.

Figure 6:
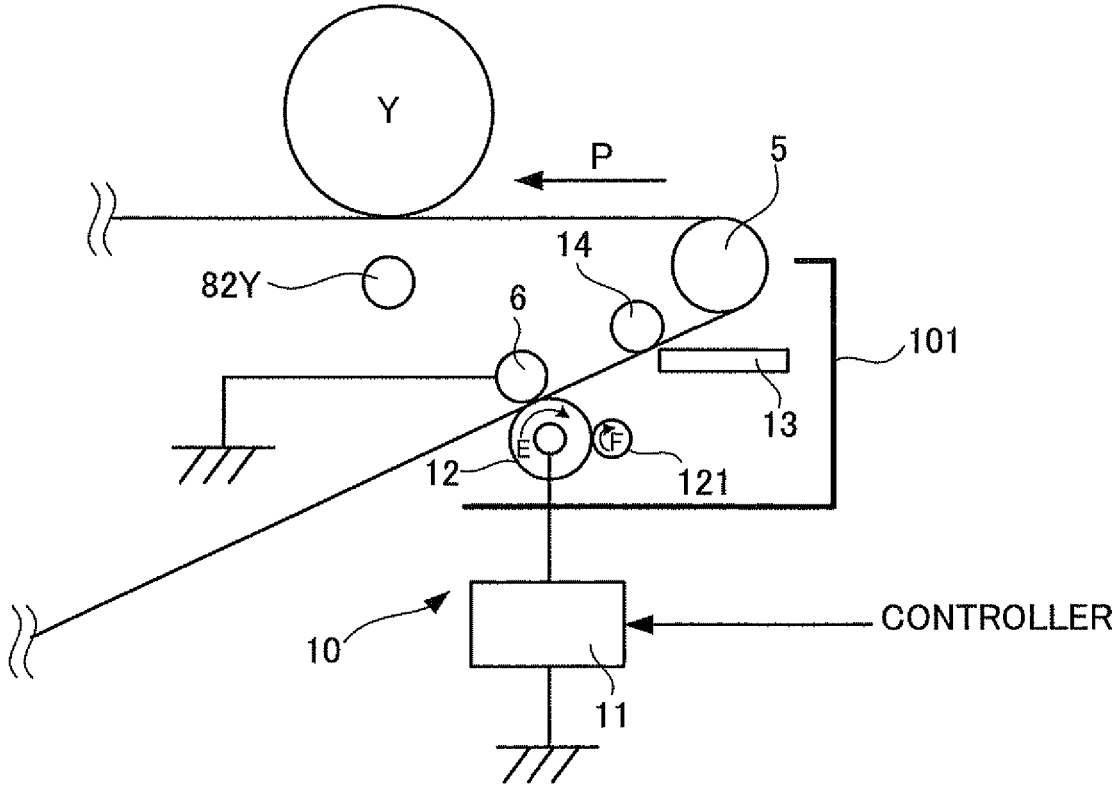
FIG. 6 is an enlarged structural diagram of the cleaning unit.

FIG. 6 is an enlarged structural diagram of the cleaning unit.

The cleaning unit 10 illustrated in FIG. 6 includes a supplementary roll 6, a power supply section 11, a cleaning brush 12, a cleaning blade 13 and an opposite roll 14. Further, the cleaning unit 10 is disposed upstream from the primary transfer position and downstream from the secondary transfer position in the moving direction of the intermediate transfer belt 90.

The supplementary roll 6 is a grounded metal roll.

The cleaning brush 12 is a conductive nylon brush having a brush density of 120,000/inch$^2$, and faces the supplementary roll 6 across the intermediate transfer belt 90 interposed in between. Further, the surface of the cleaning brush 12 moves in the direction of an arrow E at a speed double the moving speed of the intermediate transfer belt 90. Incidentally, the cleaning unit 10 also includes a remover 121 that drops the toner adhered to the cleaning brush 12 by beating while rotating in the direction of an arrow F.

The power supply section 11 is capable of applying to the cleaning brush 12 a current of −90 μA having the same polarity as the polarity of the toner used in the image forming device 1. Application of the current to the cleaning brush 12 in the power supply section 11 is either started or stopped according to an instruction from the controller 100. The controller 100 orders the power supply section 11 to start applying the current to the cleaning brush 12 when the monochrome mode is selected by the operator, and orders the power supply section 11 to stop applying the current to the cleaning brush 12 when the full-color mode is selected by the operator. A combination of the cleaning unit 10 and the controller 100 is equivalent to an example of the second charge applying section according to the present invention.

The cleaning blade 13 faces the opposite roll 14 across the intermediate transfer belt 90 interposed in between.

From the surface of the intermediate transfer belt 90 passing between the cleaning brush 12 and the supplementary roll 6, adherents such as the toner are removed. The adherents after removed from the surface of the intermediate transfer belt 90 are beaten and thereby dropped off the cleaning brush 12 by the remover 121, which are then stored in a storage box 101. When passing between the cleaning blade 13 and the opposite roll 14, the adherents not collected by the cleaning brush 12 are scraped off the intermediate transfer belt 90 by the cleaning blade 13 provided downstream in a moving direction P of the intermediate transfer belt 90.

Here, the surface potential of the intermediate transfer belt 90 passing between the cleaning brush 12, which is the conductive brush to which the current of −90 μA is applied by the power supply section 11, and the supplementary roll 6, which is the grounded metal roller, has a potential on the negative side beyond the convergence potential of the intermediate transfer belt 90. For this reason, in this image forming device 1, in the monochrome mode as well, the surface potential of the intermediate transfer belt 90 settles on the convergence potential before the image formation. The application of the charge to the belt by using this conductive cleaning brush 12 is performed via the toner. Therefore, in order to make this charge uniform, it is necessary to have a velocity relative to the belt and to increase the value of the current to a level approximately triple or larger than the value of the primary transfer current, and a sufficient effect of improving the ghost is achieved by this condition. Further, in this image forming device 1, the occurrence of the image history due to the remaining charge is suppressed by using the existing cleaning brush 12 disposed upstream from the primary transfer position and downstream from the secondary transfer position.

Next, a second exemplary embodiment of the image forming device according to the present invention will be described.

The difference between the image forming device of the second exemplary embodiment and the image forming device 1 of the first exemplary embodiment is as follows. In the image forming device 1 of the first exemplary embodiment, the negative current is applied to the cleaning brush of the cleaning unit 10 and the supplementary roll 6 is grounded so that the charge with the negative polarity is applied to the surface of the intermediate transfer belt 90, whereas in a cleaning unit 20 of the image forming device of the second exemplary embodiment, a negative potential is induced to the surface of an intermediate transfer belt 90 by applying a positive current to a supplementary roll 6 and the cleaning brush 12 is grounded.

Figure 7:
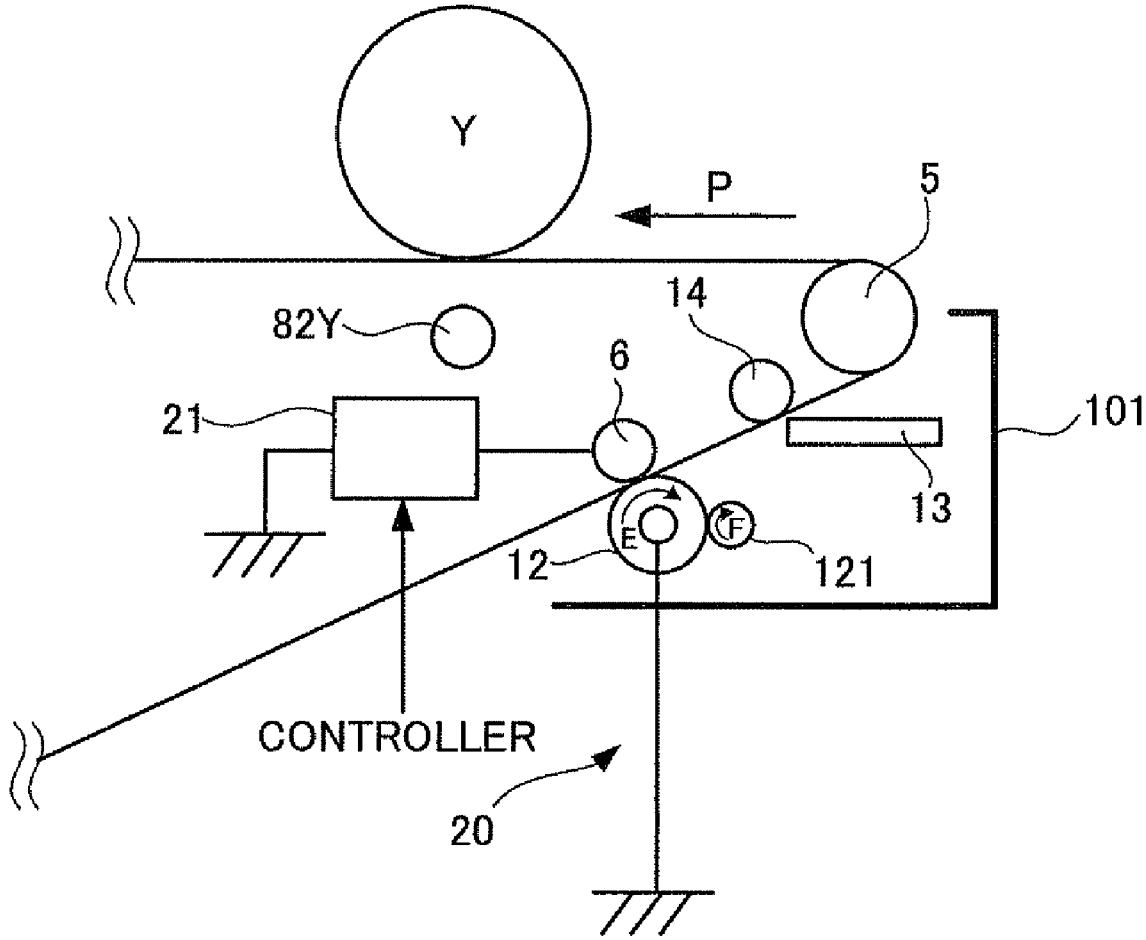
FIG. 7 is a schematic structural diagram of the cleaning unit in the image forming device of the second exemplary embodiment.

FIG. 7 is a schematic structural diagram of the cleaning unit in the image forming device of the second exemplary embodiment.

FIG. 7 illustrates a state in which in the cleaning unit 20 in the image forming device of the second exemplary embodiment, a power supply 21 is provided to apply a positive current to the supplementary roll 6 and apply a negative charge to the surface of the intermediate transfer belt 90 and the cleaning brush 12 is grounded.

After passing between the supplementary roll 6 to which the current with the positive polarity is applied by the power supply 21 and the cleaning brush 12 which is a conductive brush, a part of the intermediate transfer belt 90 has a potential on the negative side beyond the convergence potential of this intermediate transfer belt 90. For this reason, in this image forming device, the surface potential of the intermediate transfer belt 90 settles on the convergence potential before image formation. Further, in this image forming device, the occurrence of the image history due to the remaining charge is suppressed by a small number of components, i.e. by merely adding the power supply 21.

Next, a third exemplary embodiment of the image forming device according to the present invention will be described.

The difference between the image forming device of the third exemplary embodiment and the image forming device 1 of the first exemplary embodiment is as follows. In the image forming device 1 of the first exemplary embodiment, the negative current is applied to the cleaning brush of the cleaning unit 10 and the supplementary roll 6 is grounded so that the charge with the negative polarity is applied to the surface of the intermediate transfer belt 90, whereas in the image forming device of the third exemplary embodiment, a highly negative potential exceeding the convergence potential is applied to the surface of an intermediate transfer belt 90 by a charging roll 31, a power supply section 11 and a drive roll 5, having no cleaning function.

Figure 8:
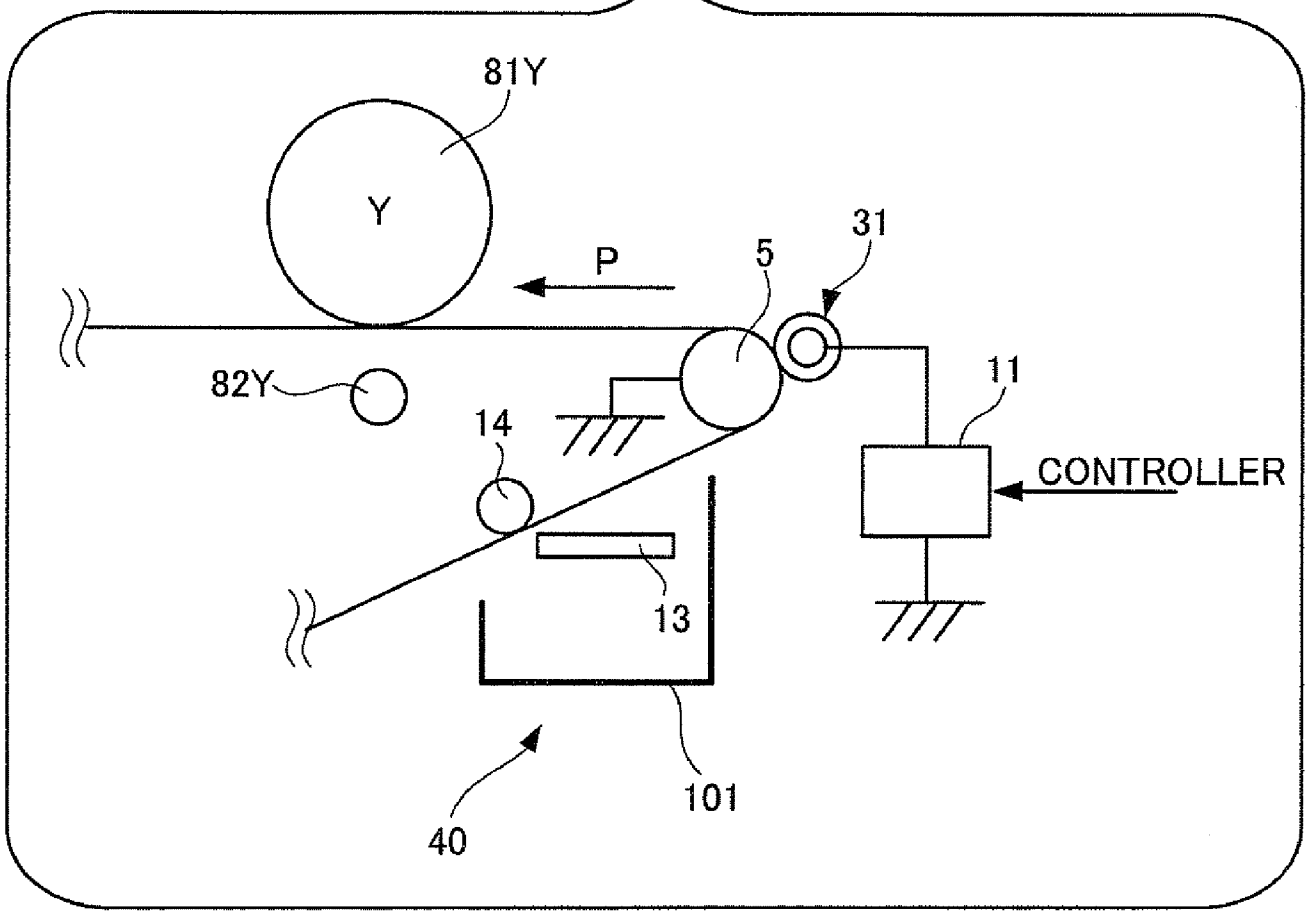
FIG. 8 is a schematic structural diagram of a part around the charging roll in the image forming device of the third exemplary embodiment.

FIG. 8 is a schematic structural diagram of a part around the charging roll in the image forming device of the third exemplary embodiment.

FIG. 8 illustrates a cleaning unit 40 having an opposite roll 4, a cleaning blade 13 facing the opposite roll 14 across the intermediate transfer belt 90 interposed in between and a storage box 101.

Further, FIG. 8 illustrates the charging roll 31 disposed at a position facing the drive roll 5 across the intermediate transfer belt 90 interposed in between, so that the charging roll 31 contacts the surface of the intermediate transfer belt 90. The power supply section 11 illustrated in FIG. 8 applies a negative current to the charging roll 31, and the drive roll 5 is grounded. Therefore, when the power supply section 11 applies the negative current to the charging roll 31 in response to an instruction from a controller 100, the surface potential of the intermediate transfer belt 90 becomes a potential on the negative side beyond the convergence potential.

Figure 9:
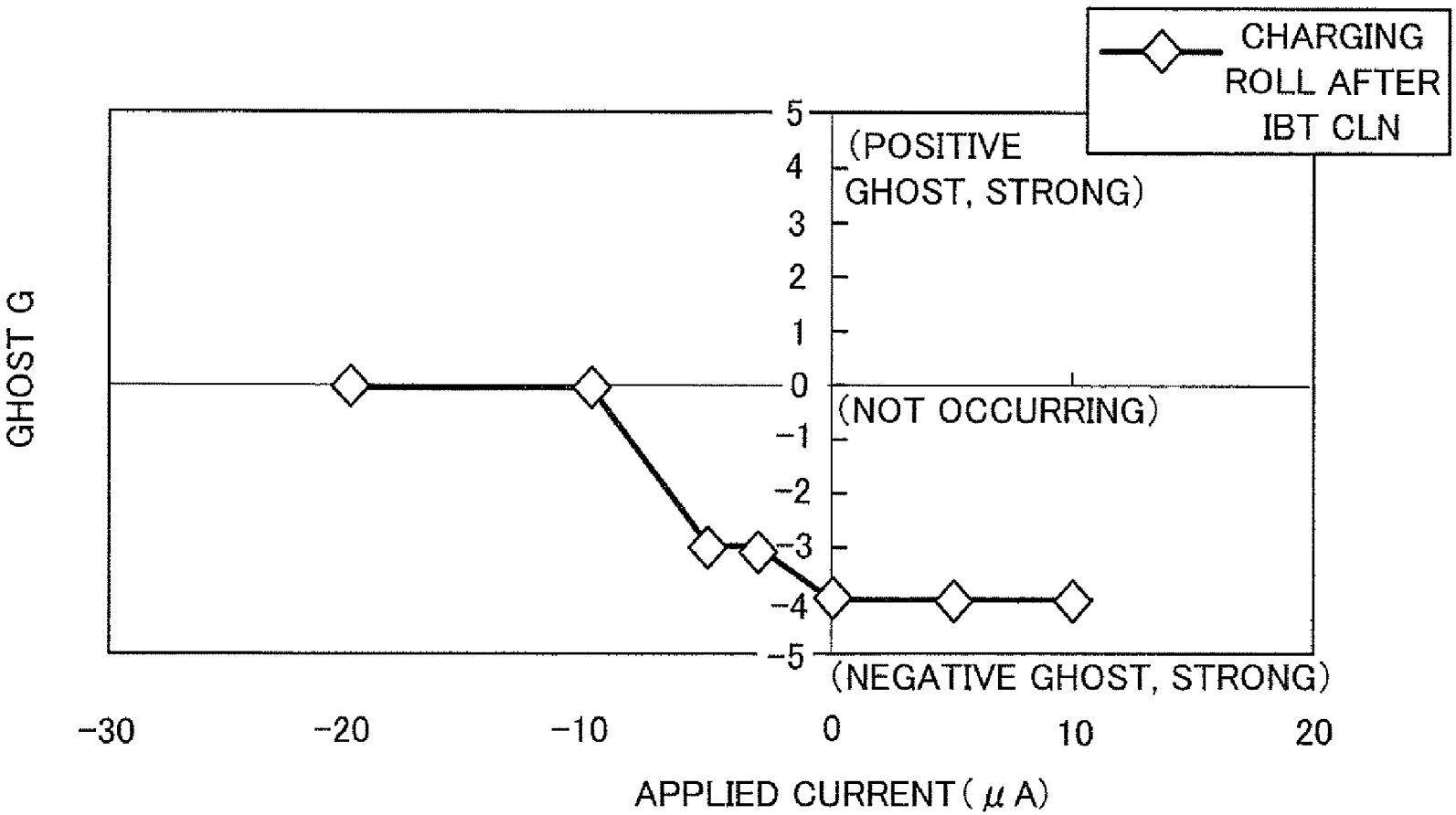
FIG. 9 is a diagram that illustrates a relationship between a current value applied to the charging roll for image formation performed when the monochrome mode is selected and the occurrence of an image history due to the remaining charge, in the image forming device of the third exemplary embodiment.

FIG. 9 is a diagram that illustrates a relationship between a current value applied to the charging roll for image formation performed when the monochrome mode is selected and the occurrence of an image history due to the remaining charge, in the image forming device of the third exemplary embodiment.

In FIG. 9, a horizontal axis indicates the value of the current applied to the charging roll 31, and a vertical axis indicates the density of the image history (ghost) due to the remaining charge. Further, when the grade (G) is "0", the image history is not caused. The larger the grade (G) on the positive side is, the higher the density of an occurring positive ghost is, whereas the larger the grade (G) on the negative side is, the higher the density of an occurring negative ghost is. Here, evaluations are made under such conditions that the process speed is 220 mm/sec, the charged width in the axis direction of the charging roll is 320 mm, the thickness of the intermediate transfer belt is 100 μm, and the volume resistivity is $1\times10^{13}$ Ωcm.

What is read from FIG. 9 is that when a negative-side current smaller than −10 μA is applied to the charging roll 31, the surface potential of the intermediate transfer belt 90 settles on the convergence potential before the image formation, which prevents the occurrence of the image history due to the remaining charge. From this fact, it is found that in the charging of the belt by the charging roll 31, an effect is produced by applying a current value of about one-third of the transfer current value required for the primary transfer.

Now, a fourth exemplary embodiment of the image forming device according to the present invention will be described.

The difference between the image forming device of the fourth exemplary embodiment and the image forming device of the third exemplary embodiment is as follows. In the image forming device of the third exemplary embodiment, the negative charge is applied by making the charging roll 31 contact the surface of the intermediate transfer belt 90, whereas in the image forming device of the fourth exemplary embodiment, a negative charge is applied by making a corotron 51 face the surface of an intermediate transfer belt 90 in a state in which the corotron 51 is separated from the surface of the intermediate transfer belt 90.

Figure 10:
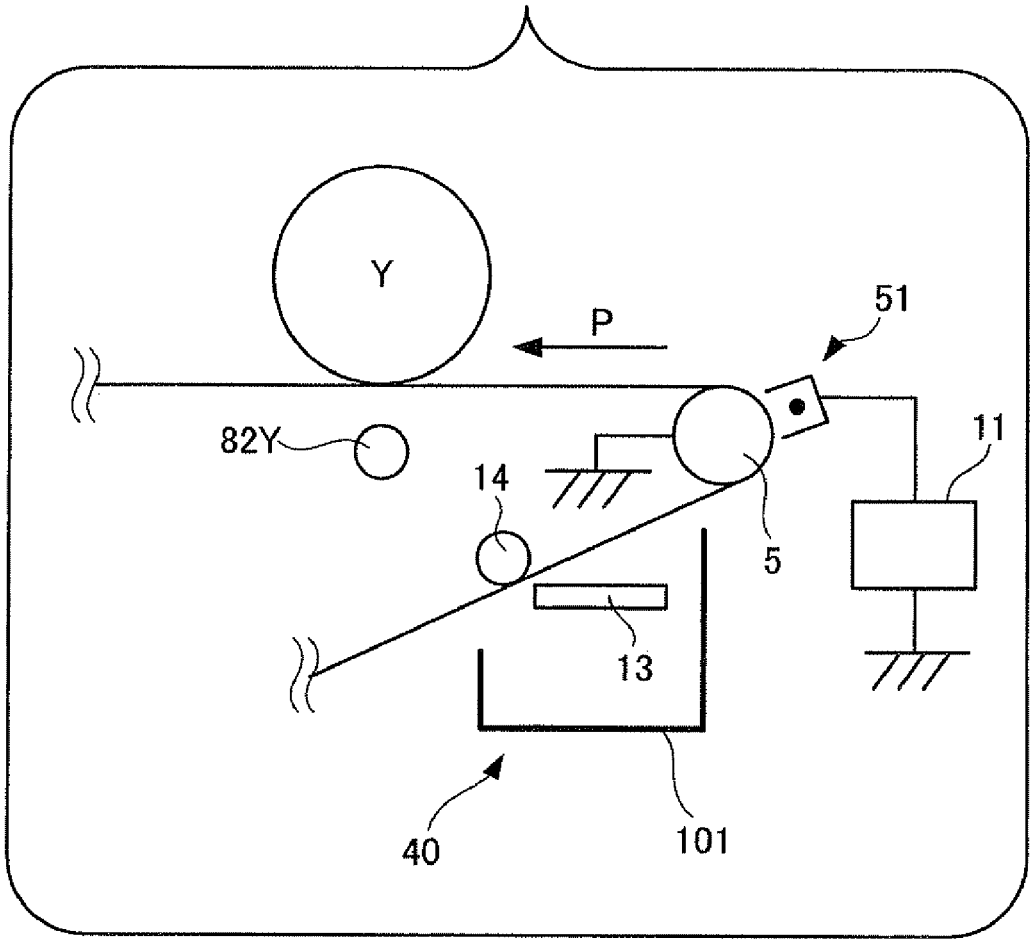
FIG. 10 is a schematic structural diagram of a part around the corotron in the image forming device of the fourth exemplary embodiment.

FIG. 10 is a schematic structural diagram of a part around the corotron in the image forming device of the fourth exemplary embodiment.

FIG. 10 illustrates the corotron 51 disposed at a position opposite a drive roll 5 across the intermediate transfer belt 90 interposed in between, in the state of being separated from the surface of the intermediate transfer belt 90. A power supply section 11 illustrated in FIG. 10 applies a negative current to the corotron 51, and the drive roll 5 is grounded. Therefore, when the power supply section 11 applies a negative current to the corotron 51 in response to an instruction from a controller 100, the surface potential of the intermediate transfer belt 90 becomes a potential on the negative side beyond the convergence potential.

Figure 11:
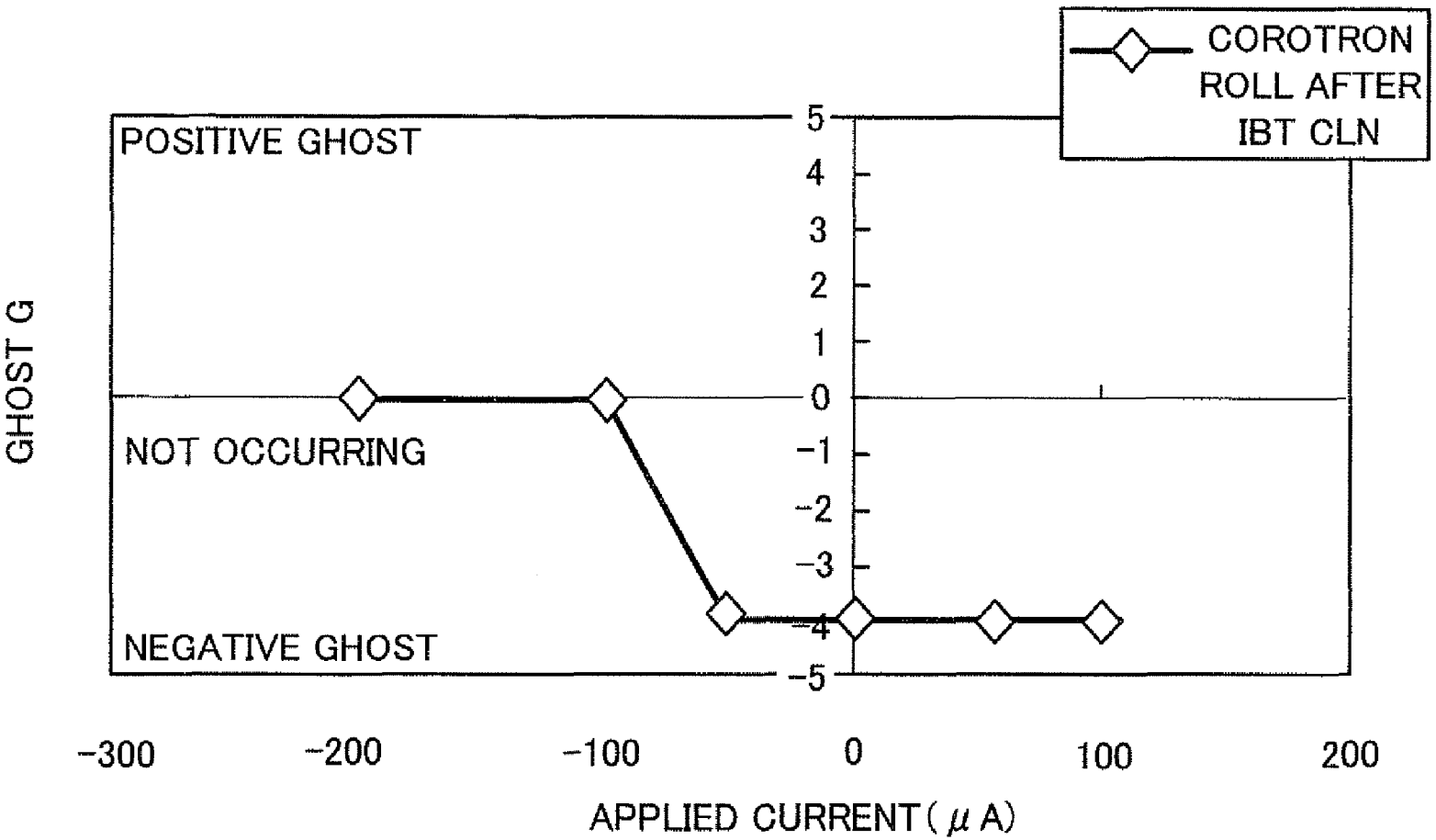
FIG. 11 is a diagram that illustrates a relationship between a current value applied to the corotron in the monochrome mode and the occurrence of an image history due to the remaining charge, in the image forming device of the fourth exemplary embodiment.

FIG. 11 is a diagram that illustrates a relationship between a current value applied to the corotron in the monochrome mode and the occurrence of an image history due to the remaining charge, in the image forming device of the fourth exemplary embodiment.

In FIG. 11, a horizontal axis indicates the value of the current applied to the corotron 51, and a vertical axis indicates the density of the image history due to the remaining charge.

What is read from FIG. 11 is that when a negative-side current smaller than −100 μA is applied to the corotron 51, the surface potential of the intermediate transfer belt 90 settles on the convergence potential before the image formation, which prevents the occurrence of the image history due to the remaining charge.

Incidentally, in the exemplary embodiments, the monochrome mode of forming an image by using only black (K) is taken as an example of the second mode according to the present invention. However, the second mode of the present invention may be any mode in which an image is formed by using fewer kinds of toner than the four kinds of toner used to form an image in the first mode. Specifically, the second mode of the present invention may be a mode in which two or one other than black out of these four kinds of toner is used to form an image.

Next, a fifth exemplary embodiment of the image forming device of the present invention will be described.

The image forming device of the fifth exemplary embodiment according to the present invention differs from the first through fourth exemplary embodiments as follows. In the image forming device (200) of the fifth exemplary embodiment, a potential measuring section 300 is provided to measure the potential of the surface of an intermediate transfer belt 90 and disposed downstream from a primary transfer roll 82K for black (K) in the moving direction of the intermediate transfer belt 90, which is different from the first through fourth exemplary embodiments. In addition, in the first through fourth exemplary embodiments, when the monochrome mode is selected, the charge is unconditionally applied to the surface of the intermediate transfer belt 90 at the position downstream from the secondary transfer position and upstream from the primary transfer position in the moving direction of the intermediate transfer belt 90, whereas in the fifth exemplary embodiment, even when a monochrome mode is selected, a charge is applied to the surface of the intermediate transfer belt 90 by a primary transfer roll 82Y for yellow (Y) only when a specific condition is satisfied.

Figure 12:
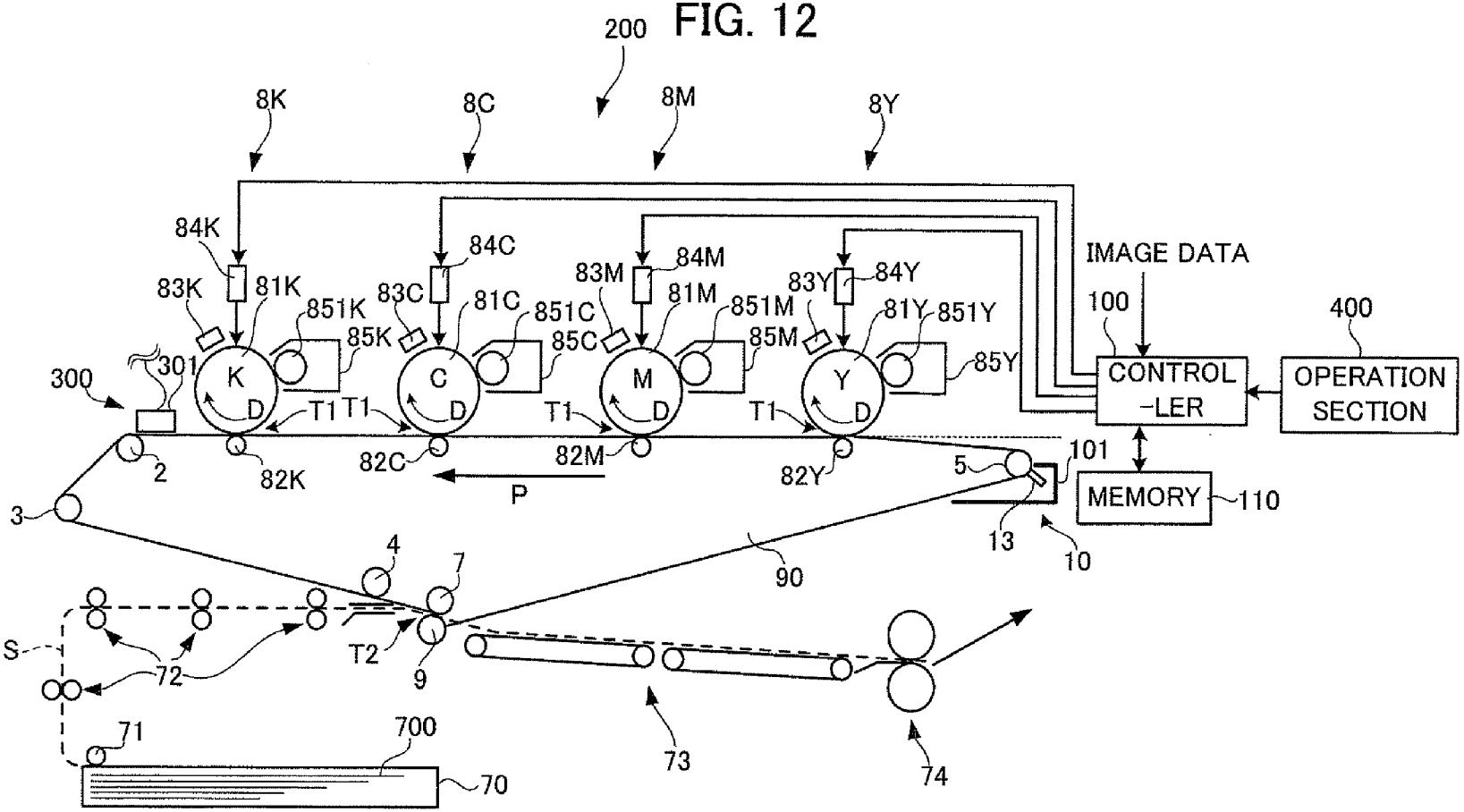
FIG. 12 is a schematic structural diagram of the image forming device of the fifth exemplary embodiment.

FIG. 12 is a schematic structural diagram of the image forming device of the fifth exemplary embodiment.

In FIG. 12, the schematic structure of the image forming device 200 of the fifth exemplary embodiment is illustrated, and the same kinds of elements as those illustrated in FIG. 1 are indicated by the same reference characters as those in FIG. 1.

Although the details will be described later, the image forming device 200 illustrated in FIG. 12 includes: the potential measuring section 300 that is provided downstream from the primary transfer position and upstream from the secondary transfer position in the moving direction of the intermediate transfer belt 90; a memory 110 that stores a negative-side maximum potential value (hereinafter referred to as "saturated potential value") acceptable by the intermediate transfer belt 90; and an operation section 400 that is used by a maintenance worker to rewrite the contents of the memory when the intermediate transfer belt is replaced, so that the saturated potential value of the intermediate transfer belt after replacement is stored.

Further, the image forming device 200 illustrated in FIG. 12 includes a cleaner 10, which is provided downstream from the secondary transfer position and upstream from the primary transfer position in the moving direction of the intermediate transfer belt 90, to clean the surface of the intermediate transfer belt 90. The cleaner 10 includes a cleaning blade 13 provided opposite a drive roll 5 across the intermediate transfer belt 90 interposed in between, and a storage box 101. The cleaner 10 cleans residues on the surface of the intermediate transfer belt 90 after the secondary transfer is completed.

Figure 13:
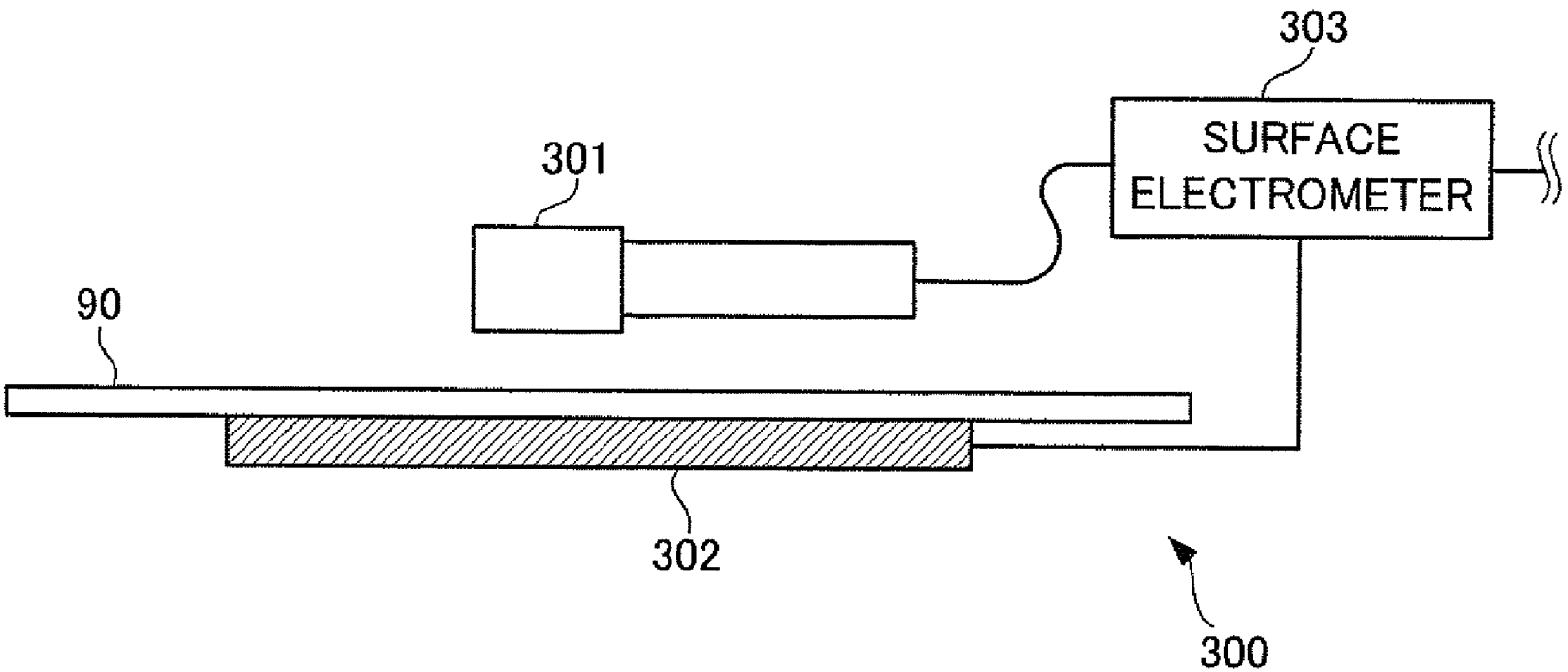
FIG. 13 is a schematic structural diagram of the potential measuring section in the image forming device illustrated in FIG. 12.

FIG. 13 is a schematic structural diagram of the potential measuring section in the image forming device illustrated in FIG. 12.

The potential measuring section 300 illustrated in FIG. 13 includes a probe 301, a conductive board 302 and a surface electrometer 303. The potential measuring section 300 measures, by using the probe 301 for measurement connected to the surface electrometer 303, the surface potential of the intermediate transfer belt 90 moving from the front to the rear in FIG. 13 while touching the conductive board 302 having a potential of 0 V. Incidentally, the principle of the measurement is well-known and thus its detailed description will be omitted.

The image forming device 200 also has a full-color mode of forming a full-color image by operating four image forming sections 8Y, 8M, 8C and 8K and a monochrome mode of forming a monochrome image by operating only the image forming section 8K for black (K). The switching between these modes is performed through operation of the operation section 400 in the image forming device 200 by an operator.

Figure 14:
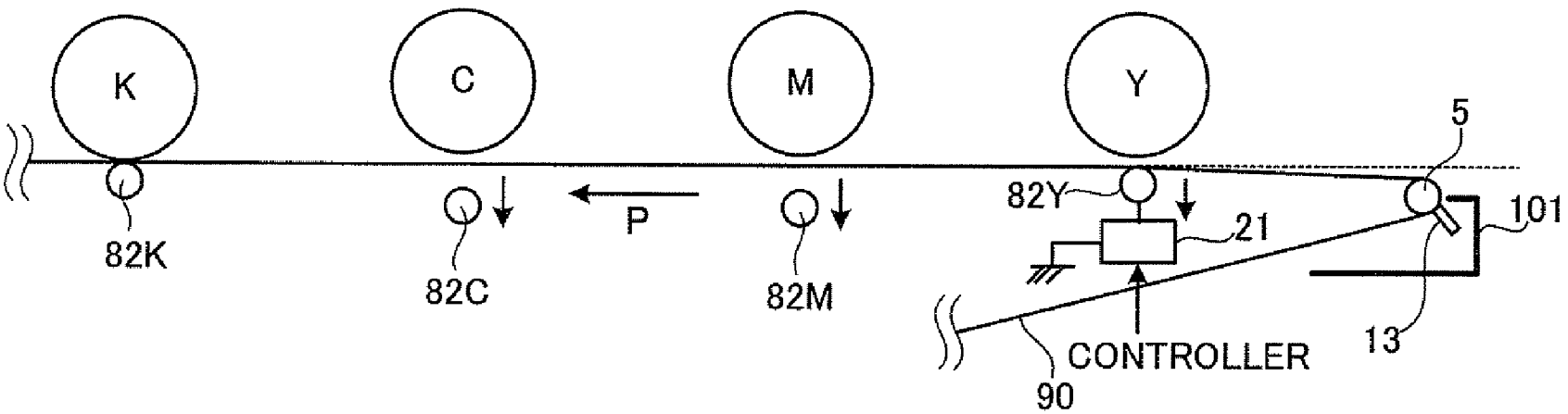
FIG. 14 is a diagram that illustrates a state of the primary transfer roll when the monochrome mode is selected by the operator.

FIG. 14 is a diagram that illustrates a state of the primary transfer roll when the monochrome mode is selected by the operator.

FIG. 14 illustrates the state in which among the four image forming sections 8Y, 8M, 8C and 8K, primary transfer rolls 82Y, 82M and 82C for yellow (Y), magenta (M) and cyan (C), respectively, are made to retreat downward.

Further, FIG. 14 illustrates a power supply 21 that applies, to the primary transfer roll 82Y for yellow (Y), in response to an instruction from a controller 100, either a charge for allowing the surface potential of the intermediate transfer belt 90 to reach the same potential as the saturated potential value of the intermediate transfer belt or a charge for transferring a toner image.

This is to prevent, since the operation of only the image forming section 8K for black (K) is sufficient in the monochrome mode, the photoreceptor rolls irrelevant to image formation from being uselessly worn out when these irrelevant photoreceptor rolls other than the photoreceptor roll for black (K) rotate while contacting the intermediate transfer belt 90 during the operation of the image forming section 8K for black (K).

Here, in the first through fourth exemplary embodiments, in the monochrome mode, the primary transfer rolls 82Y, 82M and 82C for yellow (Y), magenta (M) and cyan (C), respectively, are moved downward, thereby avoiding the contact between the intermediate transfer belt 90 and the photoreceptor rolls 81Y, 81M and 81C for yellow (Y), magenta (M) and cyan (C), respectively, as well as the contact between the intermediate transfer belt 90 and the primary transfer rolls 82Y, 82M and 82C for yellow (Y), magenta (M) and cyan (C), respectively.

In the image forming device 200 of the fifth exemplary embodiment, in the monochrome mode, the primary transfer rolls 82Y, 82M and 82C for yellow (Y), magenta (M) and cyan (C), respectively, are moved downward, thereby avoiding the contact between the intermediate transfer belt 90 and the photoreceptor rolls 81Y, 81M and 81C for yellow (Y), magenta (M) and cyan (C), respectively. However, as for the contact between the intermediate transfer belt 90 and the primary transfer rolls 82Y, 82M and 82C for yellow (Y), magenta (M) and cyan (C), respectively, the contact between the intermediate transfer belt 90 and the primary transfer rolls 82M and 82C for magenta (M) and cyan (C), respectively, is avoided, while the contact between the intermediate transfer belt 90 and the primary transfer roll 82Y for yellow (Y) is maintained because the amount of movement of the primary transfer roll 82Y for yellow (Y) is small as compared to those of the primary transfer rolls 82M and 82C for magenta (M) and cyan (C).

Further, in the image forming devices of the first through fourth exemplary embodiments, the charge is applied to the intermediate transfer belt 90 at the charge applying point located downstream from the secondary transfer position and upstream from the primary transfer roll 82Y for yellow (Y) in the moving direction of the intermediate transfer belt 90. In contrast, as for the image forming device 200 of the fifth exemplary embodiment, the charge is applied to the intermediate transfer belt 90 by the primary transfer roll 82Y for yellow (Y).

Furthermore, at the charge applying point in each of the image forming devices of the first through fourth exemplary embodiments, in the monochrome mode, the charge for allowing the surface potential of the intermediate transfer belt 90 to be a potential on the negative side beyond the convergence potential is applied to the intermediate transfer belt 90. In contrast, as for the image forming device 200 of the fifth exemplary embodiment, in the monochrome mode, a charge for allowing the surface potential of the intermediate transfer belt 90 to be the same potential as the saturated potential is applied to the intermediate transfer belt 90 by the primary transfer roll 82Y for yellow (Y). In other words, in the image forming device 200, the primary transfer roll 82Y for yellow (Y) doubles as a charge applier.

In the full-color mode, the controller 100 gives an instruction to the power supply 21 so that the power supply 21 applies the same potential as the potential applied to other primary transfer rolls to the primary transfer roll 82Y for yellow (Y).

On the other hand, in the monochrome mode, the controller 100 first determines whether the saturated potential value of the intermediate transfer belt 90 stored in the memory is a negative-side potential smaller than −100 V. Subsequently, when the value of the saturated potential is smaller than −100V, the controller 100 determines whether the value of the saturated potential and the value of the surface potential of the intermediate transfer belt 90 measured by the potential measuring section 300 are different from each other. When these values are different, the controller 100 gives an instruction to the power supply 21 so that the power supply 21 applies a charge for allowing the surface potential of the intermediate transfer belt 90 to reach the saturated potential to the primary transfer roll 82Y for yellow (Y).

Here, in the image forming device 200, even in the monochrome mode, when the value of the saturated potential stored in the memory 110 is a potential on the ground side larger than −100 V, the charge is not applied to the primary transfer roll 82Y for yellow (Y) by the power supply 21.

Figure 15:
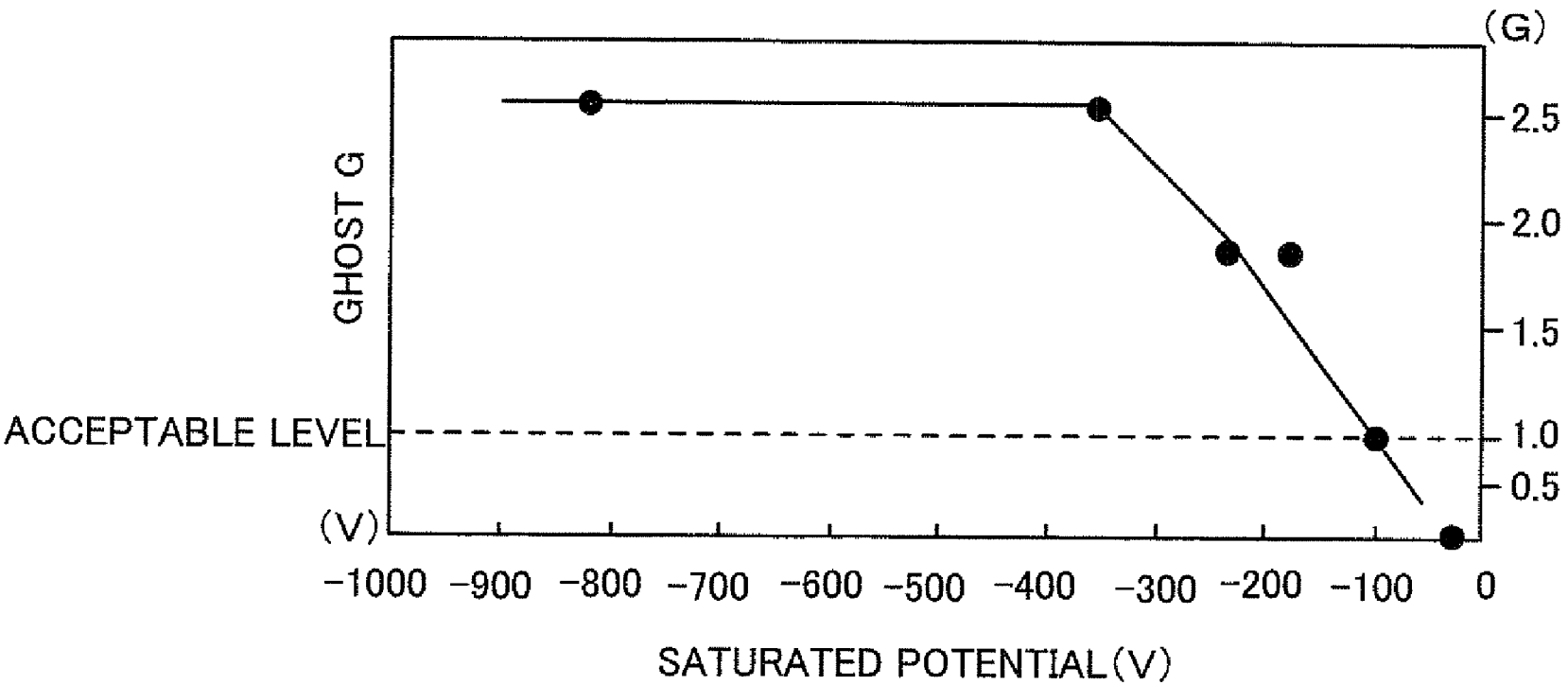
FIG. 15 is a graph that illustrates a relationship between the saturated potential and a ghost.

FIG. 15 is a graph that illustrates a relationship between the saturated potential and a ghost.

FIG. 15 illustrates, in the form of graph, the relationship between the value of the saturated potential of the intermediate transfer belt (a horizontal axis) and the maximum level of the ghost (a vertical axis) that may occur on the intermediate transfer belt having such a value of the saturated potential.

What is read from this graph is that the saturated potential, which assumes a ghost level 1 (G1) that is a threshold of allowable visibility of an occurring ghost to be a maximum ghost level, is a potential on the ground side smaller than −100 V. Therefore, in the image forming device using the intermediate transfer belt with the saturated potential on the ground side larger than −100 V, even if the surface potential measured by the potential measuring section is a potential closer to the ground side than the saturated potential, a need to make this surface potential reach the saturated potential is week and thus, the charge is not applied to the primary transfer roll 82Y for yellow (Y).

Figure 16:
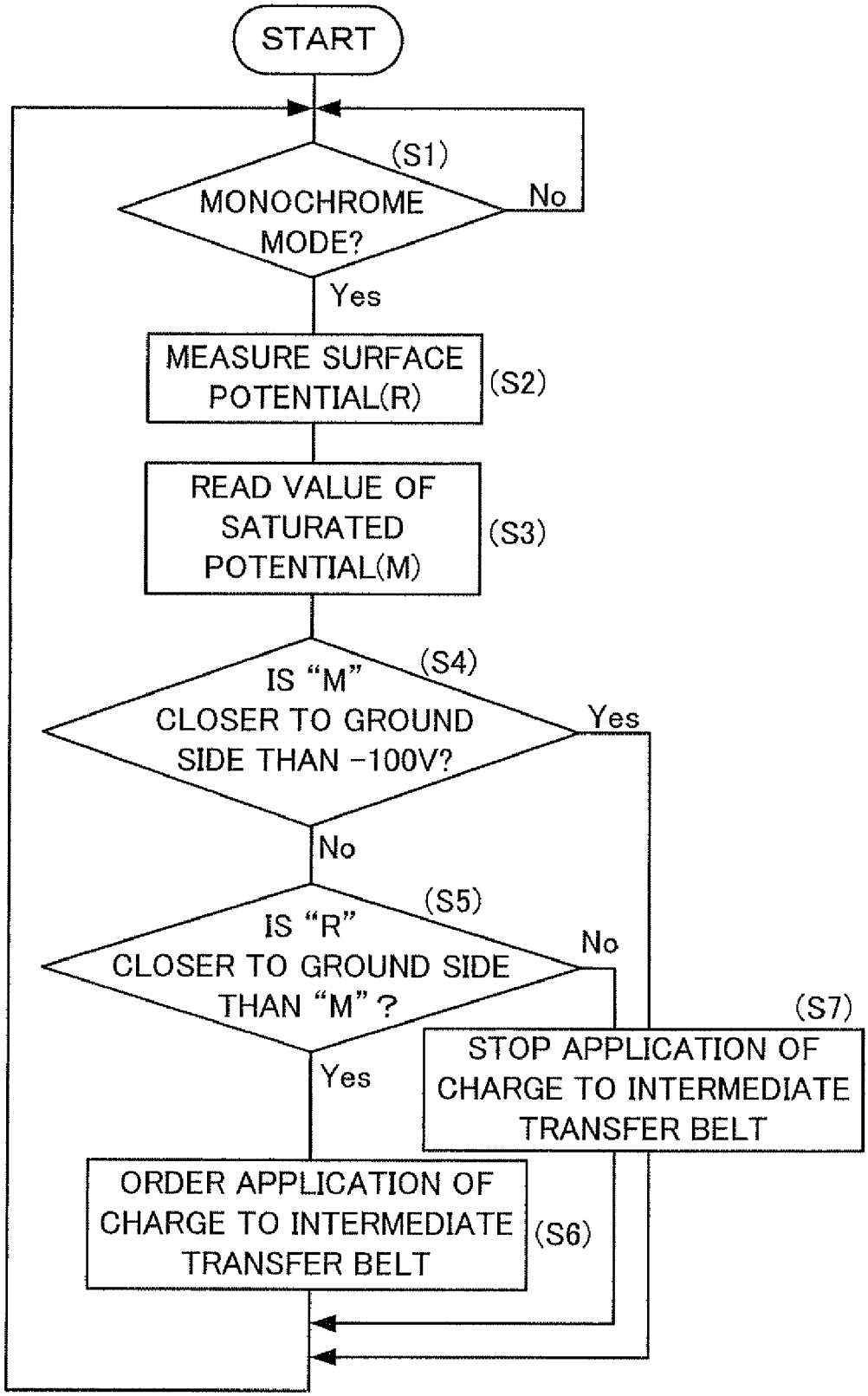
FIG. 16 is a flowchart of a program executed in the controller.

FIG. 16 is a flowchart of a program executed in the controller.

Execution of this program is initiated at power-on of the image forming device 200. In step S1, it is determined whether or not the image formation mode selected in the image forming device 200 is the monochrome mode. When it is determined that the monochrome mode is selected, the flow proceeds to step S2. In step S2, the measurement of the surface potential of the intermediate transfer belt 90 by the potential measuring section 300 is ordered. In step S3, the value of the saturated potential of the intermediate transfer belt 90 currently stored in the memory 110 is read. In step S4, it is determined whether or not the value of the saturated potential (M) is closer to the ground side than −100 V. When it is determined in step S4 that the value of the saturated potential (M) is not closer to the ground side than −100 V, the flow proceeds to step S5 where it is determined whether or not the measured surface potential (R) is closer to the ground side than the saturated potential (M). When it is determined in step S5 that the measured surface potential (R) is closer to the ground side than the saturated potential (M) the primary transfer roll 82Y for Y (yellow) is ordered to apply the charge for making the surface potential of the intermediate transfer belt 90 reach the saturated potential and then, the flow returns to step S1.

On the other hand, either when it is determined in step S4 that the value of the saturated potential (M) is closer to the ground side than −100 V, or when it is determined in step S5 that the measured surface potential (R) is not closer to the ground side than the saturated potential (M), i.e., the measured surface potential (R) is equal to the saturated potential (M), a stop on the application of the charge to the intermediate transfer belt 90 is ordered. Afterwards, the flow returns to step S1.

The fifth exemplary embodiment of the image forming device of the present invention has been described by using an example in which in the monochrome mode, when the value of the saturated potential of the intermediate transfer belt in use is closer to the ground side than −100 V, even if the value of the surface potential measured by the potential measuring section is closer to the ground side than the value of the saturated potential, the charge is not applied to the intermediate transfer belt by the primary transfer roll 82Y for yellow (Y). However, the image forming device of the present invention may be configured such that in the monochrome mode, the charge is unconditionally applied to the intermediate transfer belt by the primary transfer roll 82Y for yellow (Y) when the value of the surface potential measured by the potential measuring section is closer to the ground side than the value of the saturated potential. Further, the fifth exemplary embodiment of the image forming device of the present invention has been described by taking the primary transfer roll 82Y for yellow (Y) as an example of the second charge applying section according to the present invention. However, the second charge applying section according to the present invention may be another system provided upstream from the primary transfer roll 82Y for yellow (Y) in the moving direction of the intermediate transfer belt 90.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a plurality of image retainers that respectively retain images of respective colors formed on respective surfaces while rotating;

a plurality of image forming sections that respectively form toner images with charged toners of the respective colors on the respective surfaces of the plurality of image retainers;

a transfer accepting body that circulates on a course passing through the plurality of image retainers sequentially and has a surface to which the toner images on the respective image retainers are transferred electrostatically;

a plurality of transfer members that respectively face the plurality of image retainers across the transfer accepting body interposed in between, are given a charge that provides the image retainers with a potential difference having a polarity opposite to a polarity of the charged toners, and transfer the toner images formed on the plurality of image retainers to the transfer accepting body;

a first charge applying section that applies the charge to at least one of the transfer members and switches, according to an instruction, between a first mode of applying the charge to all the plurality of transfer members and a second mode of applying the charge to a part of the plurality of transfer members; and a second charge applying section that applies, when the charge is applied in the second mode but not in the first mode, a charge having the same polarity as the polarity of the charged toners, and having a charge value selected to cause the charge on the transfer accepting body to settle on a convergence potential before image formation, to the surface of the transfer accepting body, at an applying point located upstream from points where the toner images are transferred to the transfer accepting body in a moving direction of the transfer accepting body, wherein the convergence potential is a maximum potential value which is acceptable by the transfer accepting body, and which has a same polarity as a polarity of the charged toners.

2. The image forming device according to claim 1, wherein the transfer accepting body is held by a plurality of rotating members including a conductive rotating member disposed at the applying point, and the second charge applying section is opposite the conductive rotating member across the transfer accepting body interposed in between.

3. The image forming device according to claim 1, wherein the transfer accepting body is held by a plurality of rotating members including a conductive rotating member disposed at the applying point, and the second charge applying section applies the charge having the same polarity as the polarity of the charged toners to the surface of the transfer accepting body by applying a voltage to the conductive rotating member.

4. The image forming device according to claim 1, wherein the transfer accepting body is held by a plurality of rotating members including a conductive rotating member, the image forming device further comprises a conductive cleaning member that contacts the surface of the transfer accepting body while facing the conductive rotating member across the transfer accepting body interposed in between, and cleans the surface of the transfer accepting body, and the second charge applying section applies the charge having the same polarity as the polarity of the charged toners to the surface of the transfer accepting body by applying a voltage to the cleaning member.

5. The image forming device according to claim 1, wherein the first charge applying section applies the charge to one of the transfer members in the second mode.

6. The image forming device according to claim 1, further comprising:

a potential measuring section that measures a surface potential of the transfer accepting body at a measurement point located downstream from the point where the toner images are transferred to the transfer accepting body in the moving direction of the transfer accepting body; and a storage section that stores the convergence potential of the transfer accepting body, wherein the second charge applying section applies, when the charge is applied by the first charge applying section in the second mode and when the surface potential measured by the potential measuring section does not reach the convergence potential, the charge having the same polarity as the polarity of the charged toners to the surface of the transfer accepting body at the applying point.

7. The image forming device according to claim 1, wherein the first charge applying section applies the charge to the remainder except at least one transfer member of the part of the transfer members in the second mode, and the second charge applying section applies, to the at least one transfer member, the charge that provides the image retainers with the potential difference having the polarity opposite to the polarity of the charged toners, and the at least one transfer member is located upstream from any transfer member included in the remainder in the moving direction of the transfer accepting body.

8. An image forming device comprising:

a plurality of image retainers that respectively retain images of respective colors formed on respective surfaces while rotating;

a plurality of image forming sections that respectively form toner images with charged toners of the respective colors on the respective surfaces of the plurality of image retainers;

a transfer accepting body that circulates on a course passing through the plurality of image retainers sequentially and has a surface to which the toner images on the respective image retainers are transferred electrostatically;

a plurality of transfer members that respectively face the plurality of image retainers across the transfer accepting body interposed in between, are given a charge that provides the image retainers with a potential difference having a polarity opposite to a polarity of the charged toners, and transfer the toner images formed on the plurality of image retainers to the transfer accepting body;

a first charge applying section that applies the charge to at least one of the transfer members and switches, according to an instruction, between a first mode of applying the charge to all the plurality of transfer members and a second mode of applying the charge to a part of the plurality of transfer members;

a second charge applying section that applies, when the charge is applied in the second mode, a charge having the same polarity as the polarity of the charged toners, to the surface of the transfer accepting body, at an applying point located upstream from points where the toner images are transferred to the transfer accepting body in a moving direction of the transfer accepting body;

a potential measuring section that measures a surface potential of the transfer accepting body at a measurement point located downstream from the point where the toner images are transferred to the transfer accepting body in the moving direction of the transfer accepting body; and a storage section that stores a convergence potential being a maximum potential value which is acceptable by the transfer accepting body, and which has a same polarity as a polarity of the charged toners, wherein the second charge applying section applies, when the charge is applied by the first charge applying section in the second mode and when the surface potential measured by the potential measuring section does not reach the convergence potential, the charge having the same polarity as the polarity of the charged toners to the surface of the transfer accepting body at the applying point, and the second charge applying section applies the convergence potential to the surface of the transfer accepting body when the surface potential does not reach the convergence potential.

9. An image forming device comprising:

a plurality of image retainers that respectively retain images of respective colors formed on respective surfaces while rotating;

a plurality of image forming sections that respectively form toner images with charged toners of the respective colors on the respective surfaces of the plurality of image retainers;

a transfer accepting body that circulates on a course passing through the plurality of image retainers sequentially and has a surface to which the toner images on the respective image retainers are transferred electrostatically;

a plurality of transfer members that respectively face the plurality of image retainers across the transfer accepting body interposed in between, are given a charge that provides the image retainers with a potential difference having a polarity opposite to a polarity of the charged toners, and transfer the toner images formed on the plurality of image retainers to the transfer accepting body;

a first charge applying section that applies the charge to at least one of the transfer members and switches, according to an instruction, between a first mode of applying the charge to all the plurality of transfer members and a second mode of applying the charge to a part of the plurality of transfer members;

a second charge applying section that applies, when the charge is applied in the second mode, a charge having the same polarity as the polarity of the charged toners, to the surface of the transfer accepting body, at an applying point located upstream from points where the toner images are transferred to the transfer accepting body in a moving direction of the transfer accepting body;

a potential measuring section that measures a surface potential of the transfer accepting body at a measurement point located downstream from the point where the toner images are transferred to the transfer accepting body in the moving direction of the transfer accepting body; and a storage section that stores a convergence potential being a maximum potential value which is acceptable by the transfer accepting body, and which has a same polarity as a polarity of the charged toners, wherein the second charge applying section applies, when the charge is applied by the first charge applying section in the second mode and when the surface potential measured by the potential measuring section does not reach the convergence potential, the charge having the same polarity as the polarity of the charged toners to the surface of the transfer accepting body at the applying point, and the second charge applying section applies no charge when the convergence potential is between a potential of a ground and a predetermined threshold, even when the surface potential does not reach the convergence potential.

10. The image forming device according to claim 1, wherein the second charge applying section applies a charge of less than −100 μA.

11. The image forming device according to claim 1, wherein the second charge applying section applies a charge of less than −10 μA.

12. The image forming device according to claim 8, wherein the second charge applying section applies a charge of less than −100 μA.

13. The image forming device according to claim 8, wherein the second charge applying section applies a charge of less than −10 μA.

14. The image forming device according to claim 9, wherein the second charge applying section applies a charge of less than −100 μA.

15. The image forming device according to claim 9, wherein the second charge applying section applies a charge of less than −10 μA.

* * * * *